US011098519B2

(12) United States Patent
Dreyer

(10) Patent No.: US 11,098,519 B2
(45) Date of Patent: Aug. 24, 2021

(54) DOOR OPERATOR

(71) Applicant: ASSA ABLOY ENTRANCE SYSTEMS AB, Landskrona (SE)

(72) Inventor: Roger Dreyer, Bjarred (SE)

(73) Assignee: Assa Abloy Entrance Systems AB, Landskrona (SE)

( * ) Notice: Subject to any disclaimer, the term of this patent is extended or adjusted under 35 U.S.C. 154(b) by 152 days.

(21) Appl. No.: 16/491,066

(22) PCT Filed: Mar. 27, 2018

(86) PCT No.: PCT/EP2018/057731
§ 371 (c)(1),
(2) Date: Sep. 4, 2019

(87) PCT Pub. No.: WO2018/178054
PCT Pub. Date: Oct. 4, 2018

(65) Prior Publication Data

US 2020/0024885 A1 Jan. 23, 2020

(30) Foreign Application Priority Data

Mar. 30, 2017 (SE) ..... 1730087-2

(51) Int. Cl.
*E05F 15/00* (2015.01)
*E05F 15/73* (2015.01)

(52) U.S. Cl.
CPC ..... *E05F 15/73* (2015.01); *E05Y 2900/132* (2013.01)

(58) Field of Classification Search
CPC ..... E05F 2015/483; E05F 5/06; E05F 5/00; E05F 15/43; E05F 15/40; E05F 15/73;
(Continued)

(56) References Cited

U.S. PATENT DOCUMENTS 7,941,972 B2 * 5/2011 Kamiya ..... E05F 15/632 49/360
7,977,903 B2 * 7/2011 Kamiya ..... E05F 15/44 318/469
(Continued)

FOREIGN PATENT DOCUMENTS

DE 102006008513 9/2007
EP 0803632 10/1997
(Continued)

OTHER PUBLICATIONS

International Search Report and Written Opinion mailed in PCT/EP2018/057731 dated Jul. 19, 2018.
(Continued)

*Primary Examiner* — Chi Q Nguyen
(74) *Attorney, Agent, or Firm* — Wissing Miller LLP

(57) ABSTRACT

A door operator system and a method for moving a door leaf between a closed and open position utilize a door operator and a supervise unit. The door operator includes a control unit, a presence sensor, activation sensors, and a drive unit. The drive unit is connected to the door leaf and moves the door leaf between the open and closed position to achieve a plurality of operational states. The presence sensor is configured to monitor a risk area and send presence data associated with an object detected in the risk area to the control unit. The activation sensors are configured to monitor respective activation areas near the door leaf and send activation data associated with an object detected in the respective activation areas to the control unit. The control unit controls a movement of the drive unit based on the activation and presence data.

46 Claims, 6 Drawing Sheets

(58) Field of Classification Search
CPC ..... E05F 15/632; E05F 2017/005; E05Y 2400/504; E05Y 2400/458; E05Y 2400/502; E05Y 2800/404; E05Y 2400/852; E05Y 2400/508; E05Y 2900/132; E05Y 2400/50; E05Y 2201/254; E05Y 2400/21; E05Y 2201/25; E05Y 2201/256; E05Y 2201/21; E05Y 2400/532; E05Y 2900/531
USPC ..... 49/31, 26, 28; 250/221; 701/49, 301, 701/45, 36, 26; 340/901, 540; 318/480, 318/445
See application file for complete search history.

(56) References Cited

U.S. PATENT DOCUMENTS

| | | | | |
|---|---|---|---|---|
| 8,280,593 | B2 * | 10/2012 | Nakakura | E05F 15/43 701/49 |
| 10,956,876 | B2 * | 3/2021 | Dreyer | E05F 15/60 |
| 2001/0042820 | A1 | 11/2001 | Wilson | |
| 2003/0105559 | A1 * | 6/2003 | Avenel | G07C 9/00309 701/2 |
| 2006/0160484 | A1 * | 7/2006 | Falk | E06B 3/90 454/195 |
| 2010/0076651 | A1 * | 3/2010 | Nakakura | G01S 7/4811 701/49 |
| 2010/0082206 | A1 * | 4/2010 | Kollar | E05F 15/43 701/49 |
| 2012/0212353 | A1 * | 8/2012 | Fung | B60W 30/08 340/905 |
| 2014/0115965 | A1 * | 5/2014 | Raynal | E05F 15/79 49/31 |
| 2016/0001781 | A1 * | 1/2016 | Fung | B60K 28/02 701/36 |
| 2020/0013021 | A1 * | 1/2020 | Dreyer | E05F 15/60 |
| 2020/0208459 | A1 * | 7/2020 | Trobro | E05F 15/603 |

FOREIGN PATENT DOCUMENTS

| | | |
|---|---|---|
| EP | 2077368 | 7/2009 |
| EP | 2108775 | 10/2009 |
| JP | 2017014719 | 1/2017 |
| WO | 2004111374 | 12/2004 |

OTHER PUBLICATIONS

International-Type Search Report mailed in SE 1730087-2 dated Nov. 22, 2017.

* cited by examiner

DOOR OPERATOR

This application is a 371 of PCT/EP2018/057731 filed on Mar. 27, 2018, published on Oct. 4, 2018 under publication number WO 2018/178054, which claims priority benefits from Swedish Patent Application No. 1730087-2 filed on Mar. 30, 2017, the disclosure of which is incorporated herein by reference.

FIELD OF THE INVENTION

The present invention relates to a door operator system and a method performed in the door operator system.

BACKGROUND OF THE INVENTION

A door operator system typically comprises a door operator and units connected to the door operator such as door leaf and service equipment. A door operator typically comprises a control unit and a drive unit. The control unit controls the drive unit to move a door leaf between a closed and an open position. The control unit controls the trajectory of the door including the speed of the door, the opening angle of the door and time that the door should stay opened.

A door operator obtains input of that the door should be opened from activation sensors in the door operator that identify that a person or a vehicle is entering an activation area of the door. Further, the door operator obtains input from presence sensors in the door operator that identify that an object is present in a risk area, i.e. an area where there is a risk of come into contact with a moving door leaf.

The service of the door operator is traditionally based on a prescheduled scheme based on time and/or number of opening cycles of the door leaf. The service scheme based on this will, however, lead to that the door operator in some cases will have service to often and that parts will be replaced based on time/cycles instead of their functionality. If a user of the door operator system experiences a malfunction of the operation of the door, he will call for service. The service provider don't have any input of which part in the door operator that has a malfunction and in some cases the malfunction is even hard to identify and this will lead to that the service provider will have to return several times to find out the cause of malfunction or return a second time and replace a full set of components that could be the cause of the problem.

SUMMARY OF THE INVENTION

An object of the present disclosure is to provide a door operator system and a method which seek to mitigate, alleviate, or eliminate one or more of the above-identified deficiencies in the art and disadvantages singly or in any combination.

An object of the present disclosure is to provide a door operator system and a method that reduces the time for identifying the source of a malfunction in the door operator.

An object of the present disclosure is to provide a door operator system and a method that reduces the costs for service of the door operator.

An object of the present disclosure it to provide a door operator system and method that reduces the time for identifying a malfunction in one of the activation sensor and the presence sensor.

In this disclosure, a solution to the problem outlined above is proposed. In the proposed solution, a door operator system for moving at least one door leaf between a closed and an open position, comprising a door operator and a supervise unit. The door operator comprises a drive unit adapted to be connected to and to move the at least one door leaf between the open and closed position, at least a first presence sensor connected to a control unit and configured to monitor at least an risk area and to send presence data associated with that an object is detected in the risk area to the control unit at least a first and a second activation sensor connected to the control unit, wherein the first activation sensor is configured to monitor at least a first activation area at an outer side of the door leaf, the second activation sensor is configured to monitor at least a second activation area at an inner side of the door leaf, and the first and second activation sensors are arranged to send activation data to the control unit associated with that an object is detected in the first and/or second activation area. The control unit is connected to the drive unit and arranged to control the movement of the drive unit at least based on the received activation data and presence data. The supervise unit is connected to and adapted to receive activation data from the at least first and second activation sensors and presence data from the at least first presence sensor and configured to identify a conflicting data in a sequence of at least received activation data and presence data.

By using the door operator system according to the above a door operator system is achieved that makes it easier to identify a fault or a "ghost" impulse in a sensor. The door operator system reduces the time for identifying that a fault is due to a broken or incorrect adjusted activation sensor or presence sensor and which sensor that is causing the problem.

Further, the door operator system reduces the service costs of the door operator system. Even further, the door operator system reduces the times that a service personnel needs to visit the door operator system.

According to an aspect the supervise unit further is configured to identify an uncommon sequence of received activation data and presence data.

According to an aspect the supervise unit is configured to log data associated with of from which presence and/or activation sensor the conflicting data is received from.

According to an aspect the supervise unit is configured to log data associated with the identified uncommon sequence of (received) activation data and presence data.

According to an aspect the sequence of (received) activation data and presence data at least comprise activation data and presence data associated with a cycle of moving the door leaf from a closed position to an open position and/or from an open position to a closed position.

According to an aspect the uncommon sequence of (received) activation data and presence data is one or more of a predefined sequence of (received) activation data and presence data.

According to an aspect the logged data comprise one or more of number of uncommon sequence, type of uncommon sequence, time, from which activation and/or presence sensor a conflicting data is received from, number of contradictory data received from each activation and/or presence sensor, local temperature and local humidity.

According to an aspect the door operator comprise the supervise unit.

According to an aspect the control unit comprise the supervise unit.

According to an aspect the supervise unit comprises a data storage unit configured to store the log data and/or the activation data and/or the presence data.

According to an aspect the supervise unit is further configured to be connected to at least one remote entity and to send log data and/or activation data and/or the presence data to the at least one remote entity.

According to an aspect the door operator system further comprise a radio communication interface connected to the supervise unit and configured to communicate with at least one remote entity.

According to an aspect the supervise unit is further configured to transmit log data and/or activation data and/or the presence data to the at least one remote entity via the radio communication interface.

According to an aspect, the first and second activation sensors, the at least one first presence sensor or at least one auxiliary sensor connected to the control unit each being configured to monitor any one of the first activation area, the second activation area and the at least one risk area, are configured to detect properties associated with one ore more object detected in the first and/or second activation area or the at least one risk area and send object property data to the control unit. The supervise unit is connected to and adapted to receive object property data from the first and second activation sensor, the at least one presence sensor and/or the at least one activation sensor, whereby said supervise unit is further configured to identify the conflicting data in a sequence of activation data, presence data and object property data.

The object property data may at least comprises data indicative of the velocity of an object detected in the first and/or the second activation area or the at least one risk area, the direction of movement of an object detected in the first and/or the second activation area or the at least one risk area, the number of detected objects present in the first and/or the second activation area or the at least one risk area.

In this disclosure, a further solution to the problem outlined above is proposed. In the proposed solution, a method in a door operator system for moving at least one door leaf between a closed and an open position, comprising a door operator and a supervise unit, the method comprising: obtaining, in the door operator, a sequence of activation data and presence data from at least a first and a second activation sensor and at least a first presence sensor; receiving, in the supervise unit, activation data from the at least first and second activation sensors and presence data from the at least first presence sensor, and identifying a conflicting data in a sequence of the (received) activation data and presence data.

By using the method according to the above a door operator system is achieved that makes it easier to identify a fault or a "ghost" impulse in a sensor. The method reduces the time for identifying that a fault is due to an activation sensor or presence sensor and which sensor that is causing the problem.

Further, the method reduces the service costs of the door operator system. Even further, the method reduces the times that a service personnel needs to visit the door operator system.

According to an aspect the method comprise the step of identifying an uncommon sequence of (received) activation data and presence data.

According to an aspect the method comprise the step of logging data associated with of from which activation and/or presence sensor the conflicting data is received.

According to an aspect the method comprise the step of logging data associated with the identified uncommon sequence of (received) activation data and presence data.

According to an aspect the method comprise the step of storing, in a data storage unit, the log data and/or the activation data and/or the presence data.

According to an aspect the method comprise the step of connecting the supervise unit to at least one remote entity and to sending log data and/or activation data and/or the presence data to the at least one remote entity.

According to an aspect the step of connecting comprise connecting the supervise unit to the at least one remote entity via a radio communication interface.

According to an aspect the step of receiving comprise receiving activation data and presence data associated with at least a cycle of moving the door leaf from a closed position to an open position and/or from an open position to a closed position.

According to an aspect, the step of obtaining further comprises obtaining object property data from at least the first and second activation sensor, the first presence sensor or an auxiliary sensor, said object property data being associated with the properties of one or more objects detected by at least the first and second activation sensor, the first presence sensor or the auxiliary sensor. The step of receiving further comprises receiving object property data at least from the at least first and second activation sensors, the at least first presence sensor or the auxiliary sensor, and wherein the step of identifying further comprises identifying a conflicting data in a sequence of the received activation data, presence data and object property data.

The object property data may at least comprise data indicative of the velocity of an object detected by at least the first and second activation sensor, the first presence sensor or the auxiliary sensor, the direction of movement of an object detected by at least the first and second activation sensor, the first presence sensor or the auxiliary sensor or the number of present objects detected by at least the first and second activation sensor, the first presence sensor or the auxiliary sensor.

In this disclosure, a further solution to the problem outlined above is proposed. In the proposed solution a door operator system for moving at least one door leaf between a closed and an open position is provided, the door operating system comprising a door operator and a supervise unit. The door operator comprises a drive unit adapted to be connected to and to move the at least one door leaf between the open and closed position so as to achieve a plurality of operational states of said door leaf (5), said operational states including a closed state corresponding to the closed position of the at least one door leaf, an opened state corresponding to the open position of the at least one door leaf, an opening state defined by the at least one door leaf moving from the closed position towards the open position and a a closing state defined by the at least one door leaf moving from the open position towards the close position. The door operator further comprises at least a first presence sensor connected to a control unit and configured to monitor at least an risk area and to send presence data associated with that an object is detected in the risk area to the control unit at least a first and a second activation sensor connected to the control unit, wherein the first activation sensor is configured to monitor at least a first activation area at an outer side of the door leaf, the second activation sensor is configured to monitor at least a second activation area at an inner side of the door leaf, and the first and second activation sensors are arranged to send activation data to the control unit associated with that an object is detected in the first and/or second activation area. The control unit is connected to the drive unit and arranged to control the movement of the drive unit at least based on the received activation data and presence data. The drive unit is arranged to send operational state data associated with the state of the at least one door leaf to the control unit. The supervise unit is further connected to and adapted to receive operational state data from the drive unit and presence data from the at least first presence sensor and configured to identify a conflicting data in a sequence of at least received operational state data and presence data.

According to one aspect, the supervise unit is further configured to identify an uncommon sequence of at least operational state data and presence data.

According to one aspect, the supervise unit is configured to log data associated with of from which presence sensor the conflicting data is received from.

According to one aspect, the supervise unit is configured to log data associated with the identified uncommon sequence of at least operational state data and presence data.

According to one aspect, the logged data comprise one or more of number of uncommon sequence, type of uncommon sequence, time, from which activation and/or presence sensor a conflicting data is received from, number of contradictory data received from each activation and/or presence sensor, local temperature and local humidity.

According to one aspect, the drive unit is arranged to send posititional data associated with a door leaf position of the at least one door leaf to the control unit, and wherein the supervise unit is adapted to receive said positional data from the drive unit and configured to identify a conflicting data in a sequence of at least operational state data, presence data and posititional data.

The supervise unit may be further configured to identify an uncommon sequence of last operational state data, presence data and positional data.

According to one aspect, the supervise unit is further connected to and adapted to receive activation data from the at least first and second activation sensors and configured to identify a conflicting data in a sequence of at least operational state data, presence data and activation data.

The supervise unit may be further configured to identify an uncommon sequence of at least operational state data, presence data and activation data.

According to one aspect, the supervise unit comprises a data storage unit configured to store the log data and/or the operational state data and/or the presence data and/or the positional data and/or the activation data.

According to one aspect, the supervise unit is further configured to be connected to at least one remote entity and to send log data and/or operational state data and/or the presence data and/or the positional data and/or the activation data to the at least one remote entity.

According to one aspect, the door operator system further comprises a radio communication interface connected to the supervise unit and configured to communicate with at least one remote entity.

The supervise unit may be further configured to transmit log data and/or operational state data and/or presence data and/or positional data and/or activation data to the at least one remote entity via the radio communication interface.

In this disclosure, a further solution to the problem outlined above is proposed. In the proposed solution, a method in a door operator system for moving at least one door leaf between a closed and an open position so as to achieve a plurality of operational states of said door leaf, including a closed state corresponding to the closed position of the at least one door leaf, an opened state corresponding to the open position of the at least one door leaf (5), an opening state defined by the at least one door leaf moving from the closed towards the open position and a closing state defined by the at least one door leaf moving from the open towards the closed position, comprising a door operator and a supervise unit, the method comprising: obtaining, in the door operator, a sequence of operational state data associated with the operational state of the door leaf from drive unit and presence data from at least a first presence sensor; receiving, in the supervise unit, operational state data from the drive unit and presence data from the at least first presence sensor, and identifying a conflicting data in a sequence of the (received) operational state data and presence data.

According to one aspect, the method further comprises the step of identifying an uncommon sequence of at least operational state data and presence data.

According to one aspect, the method further comprises the step of logging data associated with of from which presence sensor the conflicting data is received.

According to one aspect, the method further comprises the step of logging data associated with the identified uncommon sequence of at least received operational state data and presence data.

According to one aspect, the step of obtaining further comprises, in the door operator, obtaining positional data associated with a door leaf position of the at least one door leaf from the drive unit, the step of receiving further comprises, in the supervise unit, receiving positional data associated with the door leaf position from the drive unit and the step of identifying further comprises identifying a conflicting data in a sequence of at least the received operational state data, presence data and positional data.

The step of identifying may further comprise identifying an uncommon sequence of least operational state data, presence data and positional data.

According to one aspect, the step of obtaining further comprises, in the door operator, obtaining activation data from at least a first and a second activation sensor, the step of receiving further comprises, in the supervise unit, receiving activation data from the at least first and second activation sensors and the step of identifying further comprises identifying a conflicting data in a sequence of at least the received operational state data, presence data and activation data.

The step of identifying may further comprise identifying an uncommon sequence of at least operational state data, presence data and activation data.

According to one aspect, the method further comprises the step of storing, in a data storage unit, the log data and/or the operational state data and/or the presence data and/or the positional data and/or the activation data.

According to one aspect, the method further comprises the step of connecting the supervise unit to at least one remote entity and to sending log data and/or operational state data and/or the presence data and/or the positional data and/or the activation data to the at least one remote entity The step of connecting may further comprise connecting the supervise unit to the at least one remote entity via a radio communication interface.

Generally, all terms used in the claims are to be interpreted according to their ordinary meaning in the technical field, unless explicitly defined otherwise herein. All references to "a/an/the [element, device, component, means, etc.]" are to be interpreted openly as referring to at least one instance of said element, device, component, means, etc., unless explicitly stated otherwise. Further, by the term "comprising" it is meant "comprising but not limited to" throughout the application.

BRIEF DESCRIPTION OF THE DRAWINGS

The foregoing will be apparent from the following more particular description of the example embodiments, as illustrated in the accompanying drawings in which like reference characters refer to the same parts throughout the different views. The drawings are not necessarily to scale, emphasis instead being placed upon illustrating the example embodiments.

DETAILED DESCRIPTION

Aspects of the present disclosure will be described more fully hereinafter with reference to the accompanying figures. The assembly disclosed herein can, however, be realized in many different forms and should not be construed as being limited to the aspects set forth herein.

The terminology used herein is for the purpose of describing particular aspects of the disclosure only, and is not intended to limit the disclosure. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

The present invention relates to door operator systems for different types of doors, door sets and door leafs. More specifically, the invention relates to door operator systems for any type of door, a sectional door, a high speed door, a gate or barrier obstructing passage, such as a revolving door, a swing door, a hinged door, an up and over door, a roll door, a garage door, an industrial door, a gate, a barrier, an or any device having the same function as a door.

According to an aspect, a door operator system comprises one or more door operators connected to one or more door leafs.

Figure 1:
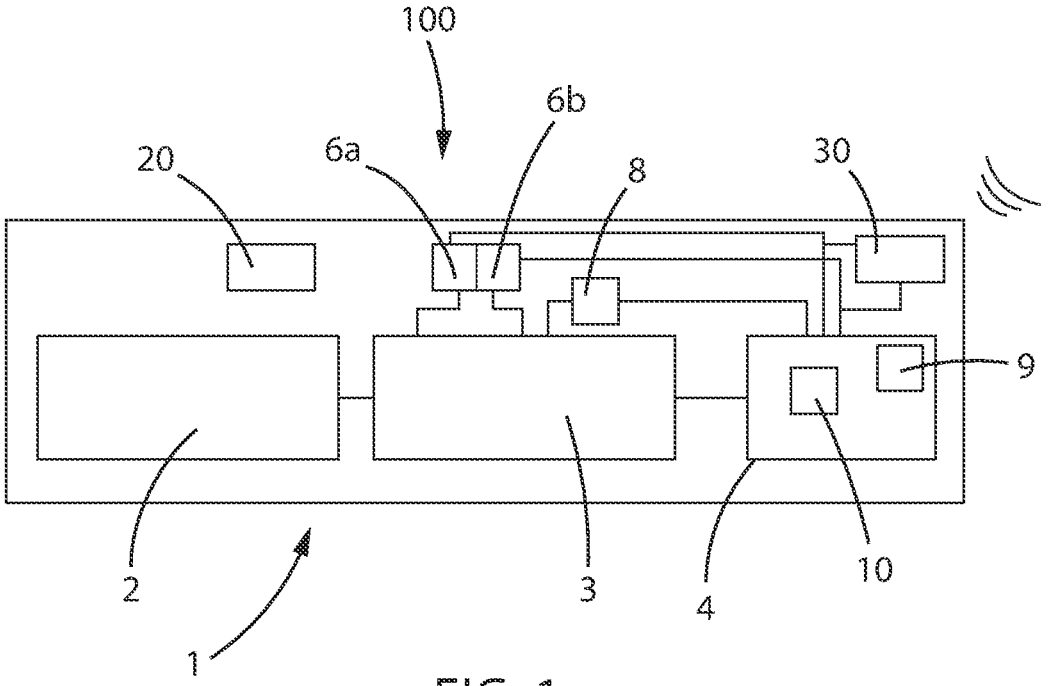
FIG. 1 discloses a schematic view of a door operator system according to an aspect of the invention.
Figure 2:
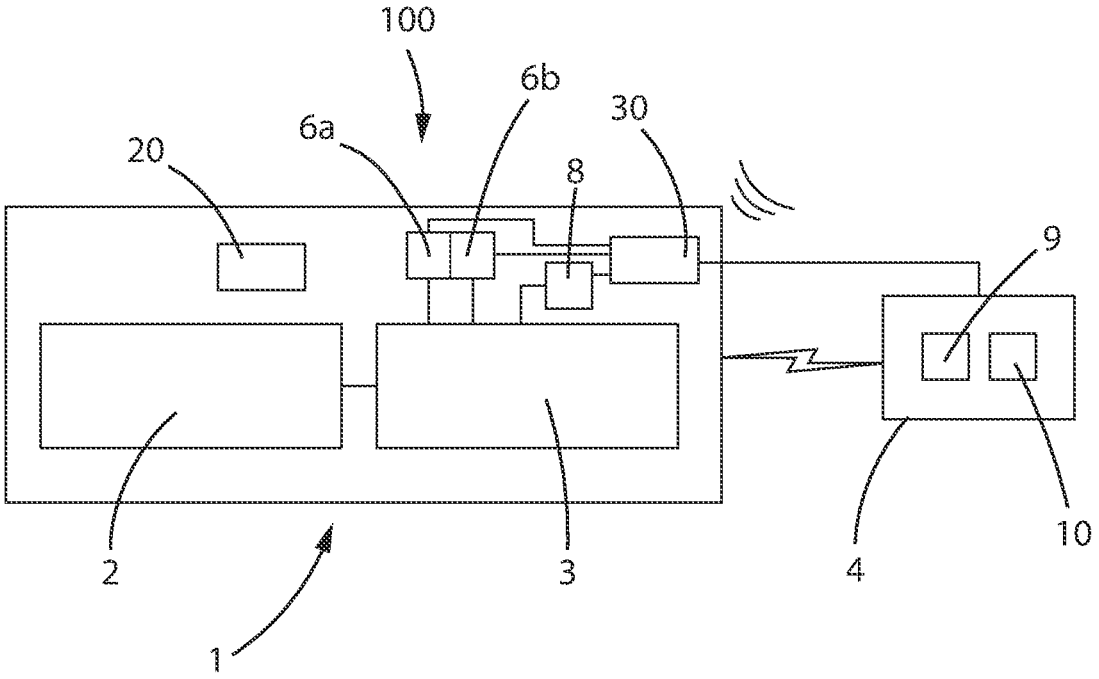
FIG. 2 disclose a schematic view of a door operator system according to an aspect of the invention.

In FIGS. 1 and 2 a door operator system 100 is disclosed comprising door operator and a supervise unit 4. The door operator is connected to the supervise unit 4.

The door operator 1 comprises a drive unit 2, a control unit 3, at least a first activation sensor 6*a* and a second activation sensor 6*b*, herein collectively referred to as first and second activation sensors 6, and at least a first presence sensor 8. The door operator further may comprise one or more of a battery (not disclosed), a belt transmission (not disclosed), a carriage wheel (not disclosed), an arm system (not disclosed) and presence sensors (not disclosed). These components as such are known in the art and will not be described in detail herein. The door operator system 100 can also comprise further components.

The drive unit 2 is connected to the control unit 3. The drive unit 2 comprise a motor and a gearbox (not disclosed). According to an aspect the drive unit 2 comprise a spring adapted to interact with the motor. The drive unit 2 is adapted to be connected to a door/door leaf/door set 5 and to move the door leaf 5 between an open and closed position, i.e. from an open position to a closed position and from a closed position to an open position. The drive unit 2 as such, its connection to the door leaf 2 and its connection to and interaction with the control unit 3 is known in the art and will thus not be described in more detail herein.

According to some aspects, the drive unit 2 is adapted to move the at least one door leaf between said open and closed position so as to achieve a plurality of operational states of said door leaf. As is known to the skilled person, such operational states are defined by the momentary movement of the door and/or the current position of the door in relation to a closed position and a open position of said door leaf. Said plurality of operational states of the one or more leaf 5 include a closed state, an opened state, an opening state and a closing state.

The closed state of the at least one door leaf 5 corresponds to the closed position of said door leaf 5. Thus, said closed state corresponds to a state where the door leaf(s) are positioned so as to prohibit passage.

The opened state accordingly correspond to the open position of said at least one door leaf 5. Thus, said opened state corresponds to a state where the door leaf(s) are positioned so as to enable passage.

The opening state is defined by the at least one door leaf 5 moving from the closed position towards the open position. The movement occurs along a movement trajectory defined by the door type, i.e. a sliding door leaf has a straight horizontal movement trajecty, a revolving door leaf or a swing door leaf has a substantially arc shaped movement trajectory. The opening state may thus be considered as defined by the movement of the at least one door leaf 5 along a movement trajectory as delimited by the closed and open position of said door leaf 5.

The closing state is accordingly defined by the at least one door leaf 5 moving from the open position towards the closed position. Similar to the opening state, the closing state may be considered as defined by the movement of the at least one door leaf 5 along the movement trajectory as delimited by the closed and open position of said door leaf 5.

According to some aspects, the drive unit 2 is arranged to send operational state data associated with the state of the at least one door leaf 5 to the control unit 3. Thus, the drive unit 2 is configured to communicate with the control unit 3 so as to enable the control of the door operator 1 based on the current state of the door leaf 5. The control unit 3 may be configured to determine the current state of the at least one door leaf based on the operational state data sent to the control unit 3. Alternatively, the drive unit 2 may be configured to determine the operational state of the one or more door leaf 5.

According to an aspect, the drive unit 2 comprises at least one position sensor configured to send position and/or movement data associated with the door leaf, whereby the drive unit 2 or the control unit 3 are configured to determine the operational state of the one more door leaf 5 based on said position and/or movement data.

The control unit 3 is connected to the supervise unit 4. The control unit 3 is connected to the at least first and second activation sensors 6. The control unit 3 is connected to the at least first presence sensor 8. The supervise unit 4 is connected to the at least first and second activation sensors 6. The supervise unit 4 is connected to the at least first presence sensor 8.

The connection between the control unit 3, drive unit 2, the at least first and second activation sensors 6, the at least first presence sensor 8 and the supervise unit 4 is according to an aspect an electronically connection as disclosed in FIG. 1.

The connection between one or more of the control unit 3, drive unit 2, first and second activation sensors 6, the at least first presence sensor 8 and the supervise unit 4 is according to an aspect an a wireless connection suitable for sending electronic signals as disclosed in FIG. 2. The connection may also be a combination of wired and wireless connection. Examples of wireless connections are Bluetooth™, WiFi, Infrared or any kind of near field communication technology.

According to some aspects the control unit 3 and the supervise unit 4 is directly connected and directly connected to the at least first and second activation sensors 6 and the at least first presence sensor 8. Directly connected means that the control unit 3 is in direct communication with the supervise unit 4, the first and second activation sensors 6, the at least first presence sensor 8 and the drive unit 2. Direct communication may occur both via a wired connection or a wireless connection or a combination of both. In the case of wireless connection there will be a transceiver for the wireless signal on both the control unit 3 side, at least first and second activation sensors 6 side, the at least first presence sensor 8 side and the supervise unit 4 side. Data can be sent to and from the supervise unit 4, to the control unit 3, the at least first and second activation sensors 6 and the at least first presence sensor 8.

The control unit 3 comprise a central processor unit (CPU) and a memory (not disclosed). The control unit 3 controls the movement of the drive unit 2. According to an aspect the supervise unit 4 is comprised in the control unit 2. According to an aspect the control unit 3 and the supervise unit 4 is an integrated unit.

The control unit 3 controls when the drive unit 2 should move the door leaf 5 between the open and closed position and how it should move it. The trajectory that the control unit 3 controls the drive unit 2 to move the door leaf 5 along comprise information of which speed the door leaf 5 should be moved, acceleration, braking, the opening time, for how long the door should be open and/or the closing speed etc. The control unit 3 can store different trajectories and control the drive unit 2 to move the door leaf 5 along different trajectories.

The control unit 3 as such is known in the art and is not described in more detail herein.

The activation sensor 6 and the presence sensor 8 are adapter to monitor an area A, B, C, D, E and provide sensor data of that a person or an object are detected in the monitored area as it enters or are located in the monitored area A, B, C, D, E. By providing sensor data is meant that the sensor 6, 8 provide/create/measure/obtains/observe an area and create data of it that could be transferred.

The activation sensors 6 monitor an activation area A, D at the door leaf 5. The first activation sensors 6 monitor a first activation area A at an outer side of the door leaf 5. The second activation sensor 6 monitor a second activation area D at an inner side of the door leaf 5. When an object or person enters into the first or second activation area A, D the activation sensors 6 detects the person or objects and obtains activation data. The activation sensors 6 send the activation data to the control unit 3 associated with that an object is detected in the first and/or second activation area A, D. The first and second activation sensors 6 also send the activation data to the supervise unit 4 associated with that an object is detected in the first and/or second activation area A, D. The first and second activation sensor 6 could comprise one or more of a radar sensor, sensor technology based on microwave radar, active or passive IR, laser technology, time of flight technology, ultrasonic technology, Video camera technology and capacitive technology. The activation area A on the outer or inner side of the door is an area that a person or objects that intends to pass through the door enters before it comes to the door.

The presence sensor 8 monitors a risk area at the door leaf 5. When an object or person enters into the risk area B, C, E the presence sensor 6 detects the person or objects and obtains activation data. The presence sensor 8 send presence data associated with that an object is identified in the risk area B, C to the control unit 3. The presence sensor 8 send presence data associated with that an object is detected in the risk area B, C to the supervise unit 4. The first presence sensor 8 could comprise one or more of a radar sensor, sensor technology based on microwave radar, active or passive IR, laser technology, time of flight technology, ultrasonic technology, Video camera technology and capacitive technology.

The activation sensors 6 and presence sensors 8 as such are known in the art and will thus not be described in more detail herein.

The control unit 3 is arranged to control the drive unit 2 to move the door leaf 5 at least based on input from the activation sensors 6 and presence sensor 8. When a person or an object such as a car or a truck is approaching the door operation system 100 it first approaches an activation area A, D either on the inner or outer side of the door leaf 5. As it enters the activation area A, D that the activation sensor 6 monitors, the activation sensor 6 detects it and sends activation data to the control unit 3 and to the supervise unit 4. The control unit 3 receives the activation data and controls the drive unit 2 to start to open the door leaf 5. After a predetermined time from having received the activation data the control unit 3 control the drive unit 2 to close the door leaf 5. If however the one of the activation sensors 6 detects that a person or an object is present in the activation area A, D it will send activation data thereof to the control unit 3. The control unit 3 will receive the activation data and interrupt the closing of the door leaf 5 and instead control the drive unit 2 to open the door leaf 5 again. This could be due to that the person have stopped and stands still in an activation area A, D or that a further person or object has entered into the activation area A, D.

The presence sensors 8 monitors risk areas B, C, E at the door operator system 100. A risk area B, C, E is an area where a moving door leaf 5 or any other moving part or the door operator system 100 could risk colliding and injuring a person or an object or the door operator system 100. When a presence sensor 8 monitors a risk area B, C, E and detects a person or an object in the risk area B, C, E it will send presence data to the control unit 3 and to the supervise unit 4. The control unit 3 receives the presence data and will control the drive unit 2 based on the received presence data. It could be to interrupt the opening of the door leaf 5 if an object is detected in the path of the opening door leaf 5. It could also be to interrupt the closing of the door leaf 5 and open the door leaf 5 again if a person or object is detected in the door opening.

The door operator 1 further comprise one or more of a battery, a belt (not disclosed), transmissions (not disclosed), an arm system (not disclosed), one or more carriage wheels (not disclosed) and one or more further sensors.

According to one aspect, the door leaf 5 is connected to one or more of the arm systems, floor guides and carriage wheels.

The door operator 1 as such can comprise further features and component that is known in the art, and will thus not be further described herein.

The door leaf 5 as such can comprise further features and component that is known in the art, and will thus not be further described herein.

The supervise unit 4 comprise a central processor unit (CPU) 9 and a memory and or a storage unit 10.

According to an aspect, the activation sensors 6 and presence sensors 8 also send the activation data and the presence data to the supervise unit 4. The supervise unit 4 receives the activation and presence data. The activation data and presence data is according to an aspect stored in the storage unit 10 of the supervise unit 4. The supervise unit 4 can according to an aspect associate further information to the received activation data and presence data. The supervise unit 4 log data associated with the presence data and activation data.

The supervise unit 4 analyse the received activation data and presence data in its CPU to identify a conflicting data in a sequence of activation data and presence data. A sequence of activation and presence data are a number of received activation and presence data. The sequence of activation and presence data are according to an aspect based on the time if where detected by the sensors 6, 8. A sequence is according to an aspect the received activation and presence data corresponding to that a person walks through the door and is detected by the activation sensors 6 and presence sensors 8 of the door operator system 100. A sequence of activation and presence data of a person walking through the door could be that the activation sensor 6 on the outer side of the door leaf 5 detects the person entering into the outer activation area A. Thereafter, as the person is in the path of the door leaf 5, the presence sensor 8 detects the person as it enters into the risk area B, C. Further, as the person has walked through the door, it enters into the inner activation area D and the inner activation sensor 6 detects the person. The sequence of received activation and presence data are thus, outer activation data, presence data and inner activation data. However, a sequence is, in many cases, more complex since there are a number of persons and objects approaching and entering through the door at the same time and after one another, persons entering at the same time as other person are leaving through the door and persons only passing by the door operator system in the activation area.

The supervise unit 4 analyse the sequence of received activation and presence data to identify a conflicting data in the sequence. By conflicting data is meant a conflicting chain of actions/sequences, incomplete chain of events/sequences/actions, illogical chain of actions/sequences, non-coherent actions/sequences/events, non-coherent execution path, chain of actions/events with mishaps and or a broken chain of sequences/events/actions. A conflicting sequence of activation data and presence data could be inner activation data directly followed by outer activation data without presence data from the presence sensors 8 in between. The sequence could be an indication of that one or more of the presence sensors 8 are broken in some way, if the sequence is from a person passing through the door and the presence sensor 8 did not detect the person. However, if the sequence is from a person only passing the activation area A without entering the door followed by a second person only passing through the activation area D on the other side of the door leaf 5 it is correct. The supervise unit 4 log data of identified conflicting data in a sequence. According to an aspect the sequence of (received) activation data and presence data at least comprise activation data and presence data associated with a cycle of moving the door leaf (5) from a closed position to an open position and/or from an open position to a closed position. According to an aspect, the supervise unit 4 analyse the sequence of received activation and presence data to identify an uncommon sequence of received activation and presence data. An uncommon sequence of data is a sequence of received activation and presence data that is theoretically possible but unlikely to occur. If one and the same uncommon sequence of received activation and presence data is detected and identified many times within a period of time, this is an indication of that one or more of the activation sensors 6 or presence sensors 8 are broken or needs to be adjusted.

According to an aspect, the properties of an object passing through the door is taken into consideration as well. The supervise unit 4 is thus configured to identify the conflicting data in a sequence of activation data, presence data and object property data.

The object property data may be obtained by the first and second activation sensors 6, the at least one presence sensor 6 or one or more auxiliary sensors or any combination of any of the aforementioned sensors.

According to an aspect, the first and second activation sensors 6 are configured to detect the properties associated with one or more object detected in the first and/or second activation area A and D. The first and second activation sensors 6 are configured to send object property data to the control unit 3. The supervise unit 4 is adapted to receive said object property data.

According to an aspect, the at least one first presence sensor 8 is configured to detect properties associated with one or more object detected in the at least one risk area B, C and E. The at least one first presence sensor 8 is configured send object property data to the control unit 3. The supervise unit 4 is adapted to receive said object property data.

According to an aspect the door operator comprises at least one auxiliary sensor. The at least one auxiliary sensor is connected to the control unit 3, each of said auxiliary sensors being configured to monitor any one of the first activation area A, the second activation area D and the at least one risk area B, C and E. The at least one auxiliary sensor is further configured to detect properties associated with one or more object detected the first and/or second activation area A, D or the at least one risk area B, C, E. The at least one auxiliary sensor is configured to send object property data to the control unit 3. The supervise unit 4 is adapted to receive said object property data.

The functionality of detecting object priority data may thus be provided by any of the conventional sensors, i.e. the activity sensors or the presence sensors or auxiliary sensors. The object property data may be any measurement related to an object known a person skilled in the field.

According to an aspect, the object property data at least comprises data indicative of the velocity of an object detected in the first and/or the second activation area A, D or the at least one risk area B, C, E, the direction of movement of an object detected in the first and/or the second activation area A, D or the at least one risk area B, C, E, the number of detected objects present in the first and/or the second activation area A, D or the at least one risk area B, C, E.

In a busy environment numerous objects will pass through the door at the same time and frequent opening and closing of the door due to objects by accident standing close enough to the door to trigger the activation sensors and in some cases even the presence sensors may occur frequently. In such an environment, the risk for uncommon sequences to frequently occur even though the activation or presence sensors operates normally is increased. Object property data allows for sorting out of events where the sensors in question operates normally but generates activation and presence data which is conflicting, increasing the reliability of the identification of conflicting data. Such a sequence may be achieved for example when a person enters the first activation area A causing the door to open and further enters the risk area B but decides to turn around and walk back without passing through the door. The sequence would thus cause the first activation sensor 6 as well as the first presence sensor 8 to detect the person without the second activation sensor 6 detecting anything. If this would occur frequently, it may be indicative of second activity sensor malfunction. However, if such a sequence further includes object property data indicative of the direction and/or the velocity of the person, the sequence may be ruled out due to the sequence not being conflicting in relation to the detected movement of the person.

Further, modern door systems usually has a number of risk zones monitored by presence sensors independent from one another, as depicted in for example FIG. 4-9. In a situation where multiple objects are moving in the vicinity of the door and said zones as well as the activation zones multiple of conflicting data will be identified by a door operator which solely compares activation sensor triggers and presence sensor triggers. However, if the objective parameter data related to the objects causing said triggers is included in the sequence erroneous conflicting data due to unexpected movement of an object or correlative movement of several objects in the monitored areas may be ruled out.

The supervise unit 4 log data associated with that conflicting data in a sequence or an uncommon sequence of activation data and presence data has been identified. The supervise unit 4 could according to an aspect store the log data in the storage unit 10. According to some aspects the supervise unit 4 log data associated with from which activation sensor 6 and/or presence sensor 8 the conflicting data is originating from. According to an aspect the supervise unit 4 is configured to log data associated with the identified uncommon sequence of received activation data and presence data. According to an aspect the uncommon sequence of received activation data and presence data is one or more of a predefined sequence of received activation data and presence data. According to an aspect the predefined sequence of activation and presence data is stored in the storage unit 10 of the supervise unit 4.

According to an aspect the supervise unit 4 log further information and data associated with the received sequence of activation and presence data. According to an aspect the logged data comprise one or more of number of uncommon sequence, type of uncommon sequence, time, from which activation and/or presence sensor 6, 8 a conflicting data is received from, number of contradictory data received from each activation and/or presence sensor 6, 8, local temperature and local humidity.

According to an aspect, the door operator 1 comprises a user interface unit 20. The user interface unit 20 is connected to the supervise unit 4. The user interface unit 20 is configured to display information to an operator of the door, a person passing through the door or service personnel.

According to an aspect of the invention, the supervise unit 4 is connected to and adapted to receive operational state data from the drive unit 2 and presence data from the at least first presence sensor 8. The supervise unit 4 is further configured to identify a conflicting data in a sequence of at least operational state data and presence data.

The drive unit 2 and presence sensors 8 also send the operational state data and the presence data to the supervise unit 4. The supervise unit 4 receives the operational state data and presence data. The operational state data and presence data is according to an aspect stored in the storage unit 10 of the supervise unit 4. The supervise unit 4 can according to an aspect associate further information to the received operational state data and presence data. The supervise unit 4 log data associated with the presence data and operational state data.

The supervise unit 4 analyse the received operational state data and presence data in its CPU to identify a conflicting data in a sequence of operational state data and presence data. A sequence of operational state data and presence data are a number of received operational state data and presence data. The sequence of operational state and presence data are according to an aspect based on the time if where detected by the sensors 6. A sequence is according to an aspect the received operational state data and presence data corresponding to that a person walks through the door and is detected by the activation sensors 6 and presence sensors 8 of the door operator system 100. A sequence of operational state data and presence data of a person walking through the door could be that the door opens, i.e. the door leaf 5 transitions from a closed state to an opening state, in response to the activation sensor 6 on the outer side of the door leaf 5 detecting the person entering into the outer activation area A. Thereafter, as the person is in the path of the door leaf 5, the presence sensor 8 detects the person as it enters into the risk area B, C. Further, as the person has walked through the door, it enters into the inner activation area D and the inner activation sensor 6 detects the person. The sequence of received activation and presence data are thus, outer activation data, presence data and inner activation data. However, a sequence is, in many cases, more complex since there are a number of persons and objects approaching and entering through the door at the same time and after one another, persons entering at the same time as other person are leaving through the door and persons only passing by the door operator system in the activation area.

To address the more complex cases, the sequence further comprises the object property data associated with the persons and objects being present in any of the zones.

The supervise unit 4 analyse the sequence of received activation and presence data to identify a conflicting data in the sequence. By conflicting data is meant a conflicting chain of actions/sequences, incomplete chain of events/ sequences/actions, illogical chain of actions/sequences, non-coherent actions/sequences/events, non-coherent execution path, chain of actions/events with mishaps and or a broken chain of sequences/events/actions. A conflicting sequence of activation data and presence data could be inner activation data directly followed by outer activation data without presence data from the presence sensors 8 in between. The sequence could be an indication of that one or more of the presence sensors 8 are broken in some way, if the sequence is from a person passing through the door and the presence sensor 8 did not detect the person. However, if the sequence is from a person only passing the activation area A without entering the door followed by a second person only passing through the activation area D on the other side of the door leaf 5 it is correct. The supervise unit 4 log data of identified conflicting data in a sequence.

It is noted that it is not required for the activation sensors to be involved according to present aspect.

According to an aspect, the supervise unit 4 analyse the sequence of at least received operational state and presence data to identify an uncommon sequence of received operational state data and presence data. An uncommon sequence of data is a sequence of operational state data and presence data that may theoretically possible but unlikely to occur or a a sequence of received operational state data and presence data which in reality is substantially implausible. If one and the same uncommon sequence of received operational state data and presence data is detected and identified many times within a period of time, this is an indication of that one or more of the presence sensors 8 are broken or needs to be adjusted.

The supervise unit 4 log data associated with that conflicting data in a sequence or an uncommon sequence of operational state data and presence data has been identified. The supervise unit 4 could according to an aspect store the log data in the storage unit 10. According to some aspects the supervise unit 4 log data associated with from which presence sensor 8 the conflicting data is originating from. According to an aspect the supervise unit 4 is configured to log data associated with the identified uncommon sequence of received operational state data and presence data.

Figure 3:
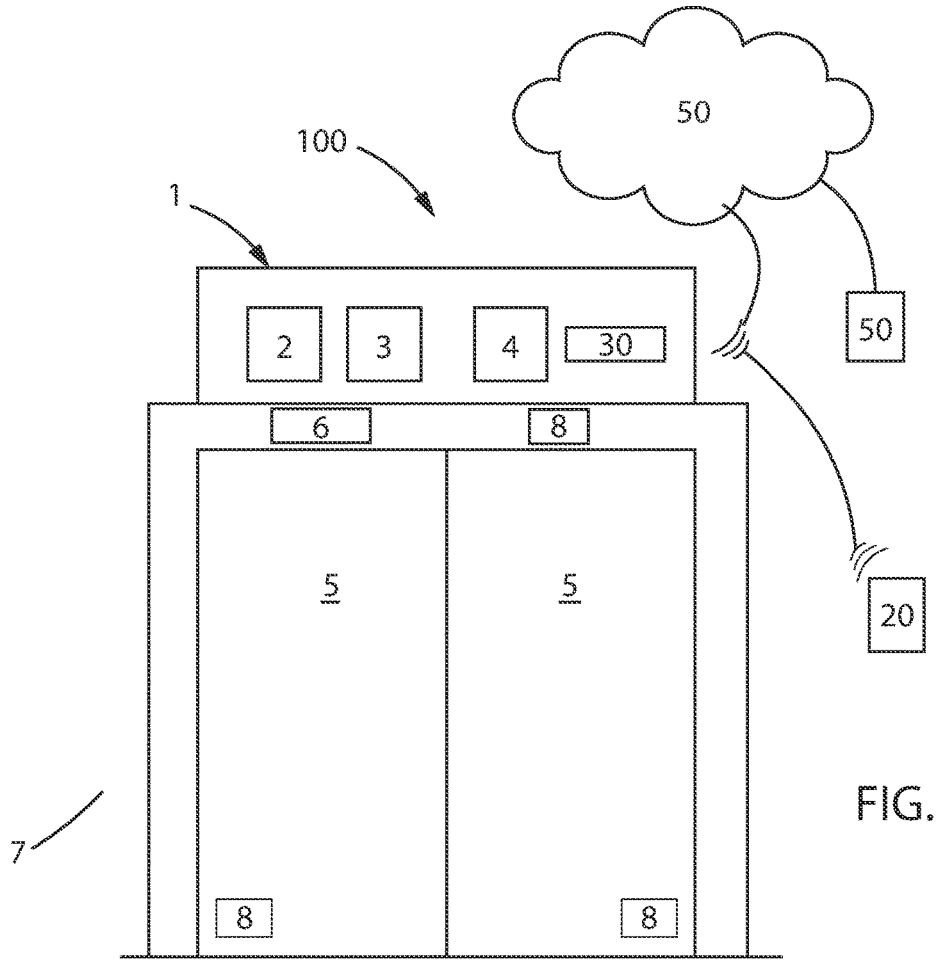
FIG. 3 shows a schematic view of a sliding door and a door operator system in accordance with an aspect of the invention.

According to an aspect, the door operator 1 further comprise a radio communication interface 30 connected to the supervise unit 4 and configured to communicate with at least one remote entity 50, as disclosed in FIG. 3. The radio communication interface 30 may be comprised as any number of transceiving, receiving, and/or transmitting units or circuitry. It should further be appreciated that the radio communication interface 30 may be in the form of any input/output communications port known in the art. The radio communication interface 30 may comprise RF circuitry and baseband processing circuitry. The radio communication interface 30 may support either wireless and/or wired communication. Examples of wireless communication may be Global System for Mobile Communication, GSM, Bluetooth, narrowband communication, Internet of Things, IoT, specific communication.

According to an aspect the door operator 1 is arranged to be connected to the remote entity 50 via a cord.

According to an aspect, the one or more remote entity 50 is a server, a database, a further door operator and/or the cloud 50.

If the supervise unit 4 identifies that conflicting data from one activation and/or presence sensor 6, 8 or that an uncommon sequence occur often it could send information thereof to a service personnel. The information could be sent via the user interface 20 and/or via the radio communication unit 30. According to an aspect the information is the log data. According to an aspect the information is the activation data and presence data. According to an aspect the information is the identified conflicting sequences of activation data and presence data. According to an aspect the information is data associated with the identified uncommon sequences.

If a service is to be performed on the door operator system 100, either as a scheduled service or due to a breakdown of one or more components of the door operator system 100, the service personnel can obtain the log data and identify which activation sensor 6 or presence sensor 8 that has some sort of malfunction. In some cases a activation sensor 6 or a presence sensor 8 can produce "ghost" impulses and send activation data or presence data to the control unit 3 and the supervise unit 4 even though no person or object is present in the activation or risk area A, B, C, D, E. Without the input from the supervise unit 4 to the service personnel it would be hard to identify the cause of the malfunction of the door operator system 100.

Figure 4:
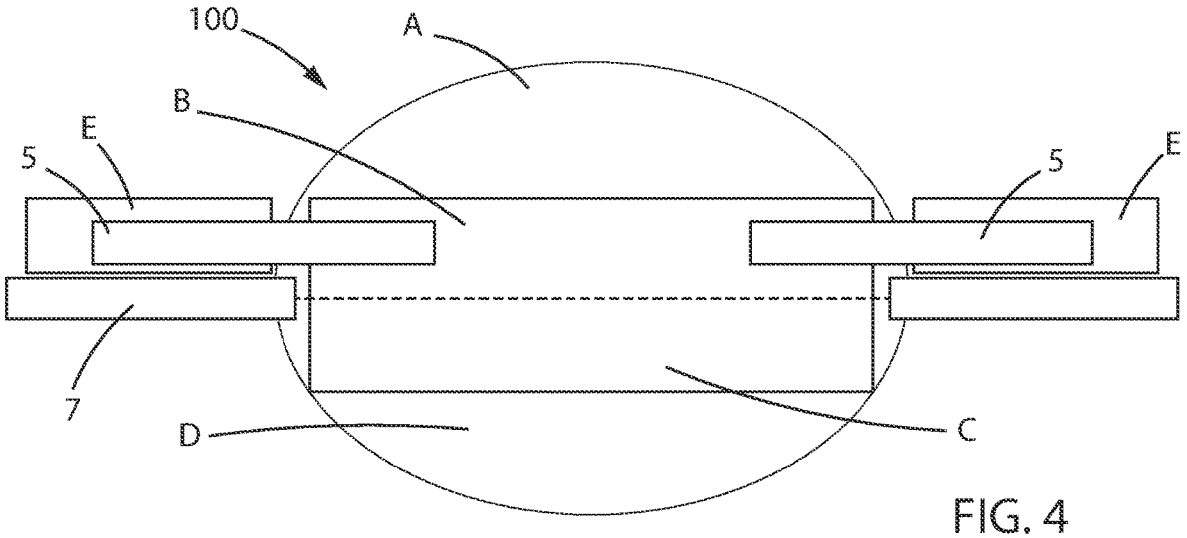
FIG. 4 shows a cross sectional view of the sliding door and the door operator system in FIG. 4.

The door operator system 100 disclosed in FIGS. 3 and 4 is a sliding door operator system 100 comprising a sliding door operator 1 connected to two door leafs 5 in accordance with the above. The door operator 1 is connected to the remote entity 50 and the user interface 20 via the radio communication unit 30. The door operator system 100 is mounted to a wall 7.

The door operator comprises a first and a second activation sensor 6. The first activation sensor 6 monitor an outer activation area A in front of the door leafs 5. The second activation sensor 6 monitor an inner activation area D on the inner side of the door leaf 5. The door operator 1 comprises a first presence sensor 8, a second presence sensor 8, a third presence sensor 8 and a fourth presence sensor 8. The first presence sensor 8 monitor an outer risk area B in front of the door leafs 5. The second presence sensor 8 monitor an inner risk area C on the inner side of the door leaf 5. The third presence sensor 8 monitors a risk area E corresponding to the position of one of the door leaf 5 in its open position. The fourth presence sensor 8 monitors a risk area E corresponding to the position of the other of the door leaf 5 in its open position.

The first and second activation sensors 6 and first, second, third and fourth presence sensors 8 monitor the activation and presence areas A, B, C, D, E of the door operator system 100. When a sensor 6, 8 detects a person or an object in the area A, B, C, D, E which it monitors it creates and send activation and presence data to the control unit 3 and the supervise unit 4.

According to an aspect the conflicting data and/or uncommon sequence of activation and presence data is that one of the presence sensors 8 detects and sends presence data to the supervise unit 4 when the door leafs 5 is in a closed position and if the first or second activation sensor 8 has not detected anything. If the supervise unit 4 identifies this conflicting data or uncommon sequence frequently (for instance 1 out of 10 openings), this is an indication of that there is a potential malfunction in one or more of the sensors 6, 8 in the door operator 1. According to an aspect the potential problem could be the first activation sensor 6 of the first presence sensor 8 that detects and creates the presence data. According to an aspect the potential problem could be the second activation sensor 6 of the second presence sensor 8 that detects and creates the presence data.

According to an aspect a conflicting data and/or uncommon sequence of activation and presence data is that if any presence sensors 8 detects a person or an object in a risk area B, C, E when the door leaf 5 is closing and at the same time, the first or second activation sensor 8 does not detect anything in the inner or outer activation area A, D. If the supervise unit 4 identifies this conflicting data or uncommon sequence, this is an indication of that there is a potential malfunction if this occurs frequently (for instance 1 out of 10 openings) in the same position of the door leaf 5. According to an aspect the potential problem could be the presence sensor 8 that detects a person or an object. A solution to the problem could be to adjust or replace the presence sensor 8.

According to an aspect a conflicting data and/or uncommon sequence of activation and presence data is that the third or fourth presence sensors 8 that is monitoring the risk area E is detecting an person or object frequently (more than 1 out of 10 openings) when the door is opening. According to an aspect the potential problem could be that the third or fourth presence sensors 8 need to be adjusted or replaced.

According to an aspect a conflicting data and/or uncommon sequence of activation and presence data is that the first or second activation sensor 6 is detecting a person or an object frequently (1 out of 10) without any of the first or second presence sensor 8 is detecting anything.

According to an aspect the potential problem could be that the first or second activation sensor 6 that is detecting an object needs to be adjusted or replaced.

According to an aspect the potential problem could be that the first or second activation sensor 6 that is detecting an object needs to be replaced with another type of activation sensor that ignores cross traffic at the door leaf 5.

According to an aspect a conflicting data and/or uncommon sequence of activation and presence data is that the first of second activation sensor 6 is detecting a person or an object frequently (1 out of 10) at the same position during closing of the door leafs 5. According to an aspect the potential problem could be that the first or second activation sensor 6 that is detecting an object needs to be adjusted or replaced.

Figure 5:
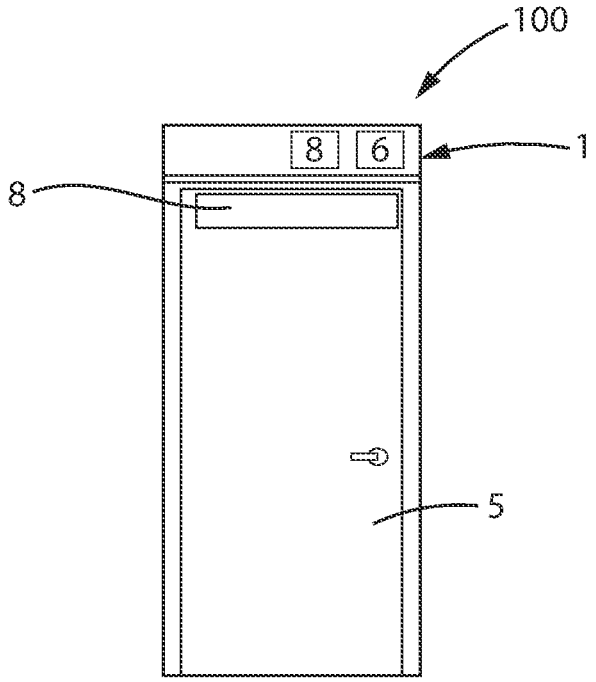
FIG. 5 shows a schematic view of a swing door and a door operator in accordance with an aspect of the invention.
Figure 6:
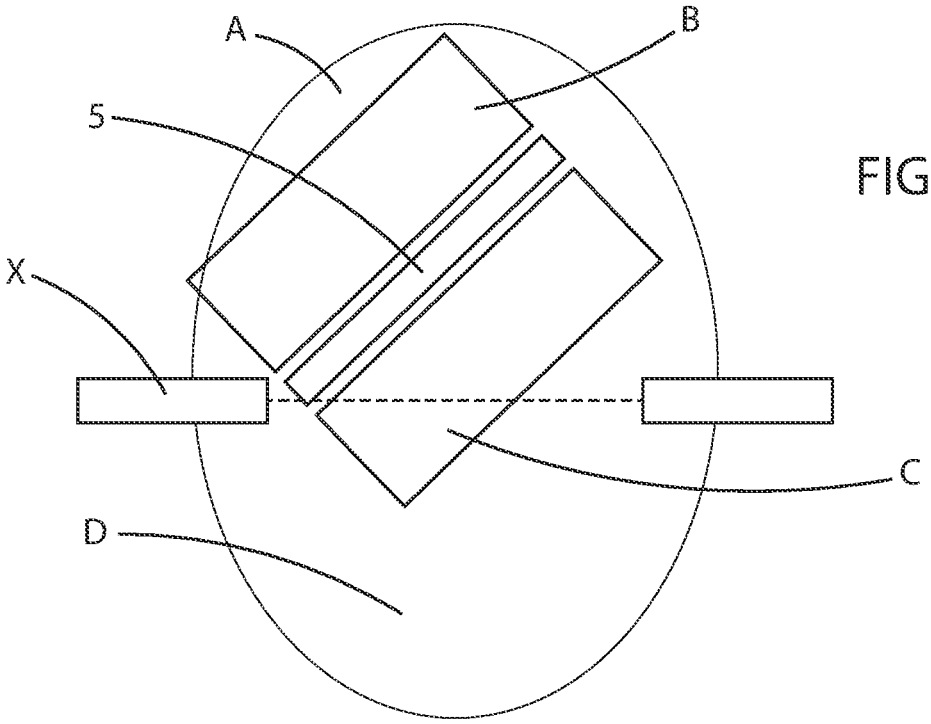
FIG. 6 shows a cross sectional view of the swing door and the door operator system in FIG. 5.

The door operator system 100 disclosed in FIGS. 5 and 6 is a swing door operator 1 connected to door leaf 5 accordance with the above. The door operator 1 could be connected to the remote entity 50 and the user interface 20 via the radio communication unit 30. The door operator system 100 is mounted to a wall 7.

The door operator comprises a first and a second activation sensor 6. The first activation sensor 6 monitors an outer activation area A in front of the door leaf 5. The second activation sensor 6 monitor an inner activation area D on the inner side of the door leaf 5. The door operator 1 comprises a first presence sensor 8 and a second presence sensor 8. The first presence sensor 8 is connected to the door leaf 5 and monitors an outer risk area B in front of the door leaf 5. The second presence sensor 8 is connected to the opposite side of the door leaf 5 and monitors an inner risk area C on the inner side of the door leaf 5.

The first and second activation sensors 6 and first and second presence sensors 8 monitor the activation and presence areas A, B, C, D of the door operator system 100. When a sensor 6, 8 detects a person or an object in the area A, B, C, D which it monitors it creates and send activation and presence data to the control unit 3 and the supervise unit 4.

According to an aspect a conflicting data and/or uncommon sequence of activation and presence data is that the inner or outer presence sensor 8 detects a person or an object when the door is closed, and at the same time the outer or inner activation sensors is not detecting anything. If this conflicting data and/or uncommon sequence of activation and presence data occurs frequently (1 out of 10 openings) this is an indication of a potential malfunction.

According to an aspect the potential problem could be that the inner activation sensors 6 is broken or need adjustment, if it is the inner presence sensor 8 that is detecting a person or object.

According to an aspect the potential problem could be that the outer activation sensors 6 is broken or need adjustment, if it is the outer presence sensor 8 that is detecting a person or object.

According to an aspect a conflicting data and/or uncommon sequence of activation and presence data is that the inner presence sensor 8 detects a person or an object in the risk area C when the door is moving to its closed position, and at the same time inner or outer activation sensors is not detecting anything in the activation areas A, D. If this conflicting data and/or uncommon sequence of activation and presence data occurs frequently (1 out of 10 openings) this is an indication of a potential malfunction.

According to an aspect the potential problem could be that the inner presence sensors 8 is broken or need adjustment.

According to an aspect a conflicting data and/or uncommon sequence of activation and presence data is that the outer presence sensor 8 frequently (more than 1 out of 10) detects a person or an object in the same position the risk area B when the door is moving to its open position.

According to an aspect the potential problem could be that the outer presence sensors 8 is broken or need adjustment.

According to an aspect a conflicting data and/or uncommon sequence of activation and presence data is that the first or second activation sensor 6 is detecting a person or an object frequently (1 out of 10) in the activation area A, D without the inner first presence sensor 8 is detecting anything in the risk areas C.

According to an aspect the potential problem could be that the first or second activation sensor 6 that is detecting an object needs to be adjusted or replaced.

According to an aspect the potential problem could be that the first or second activation sensor 6 that is detecting an object needs to be replaced with another type of activation sensor that ignores cross traffic at the door leaf 5.

According to an aspect the potential problem could be that the inner first presence sensor 8 that not is detecting an object needs to be adjusted or replaced.

According to an aspect a conflicting data and/or uncommon sequence of activation and presence data is that the first or second activation sensor 6 frequently (1 out of 10) is detecting a person or an object in the same position in the activation area A, D. According to an aspect the potential problem could be that the first and second activation sensors 6 needs to be adjusted or replaced. According to an aspect the potential problem could be that the activation sensors 6 detects reflections from the door leafs 5 or arm system.

Figure 7:
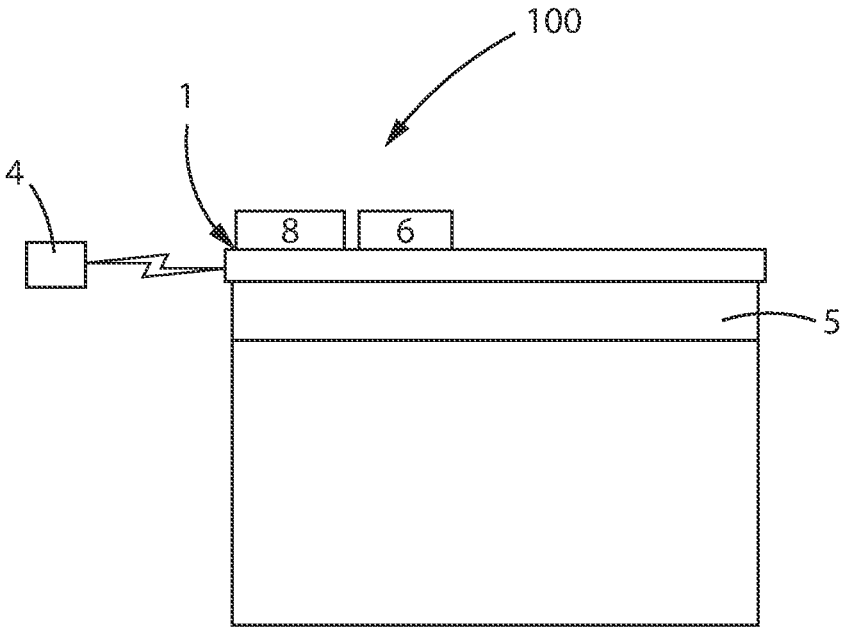
FIG. 7 shows a schematic view of a roll door and a door operator system in accordance with an aspect of the invention.
Figure 8:
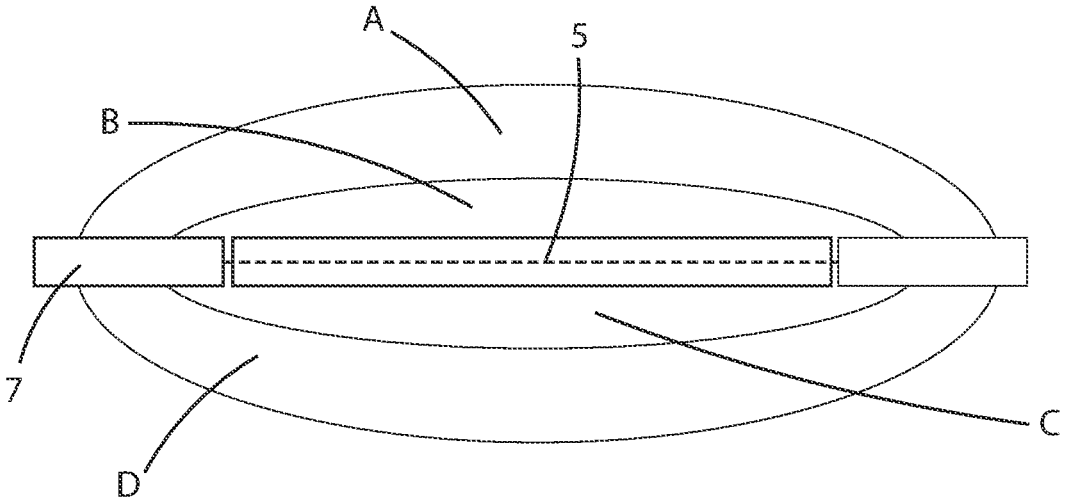
FIG. 8 shows a cross sectional view of the roll door and the door operator system in FIG. 7.

The door operator system 100 disclosed in FIGS. 7 and 8 is a roll door operator 1 connected to door leaf 5 accordance with the above. The door operator 1 could be connected to the remote entity 50 and the user interface 20 via the radio communication unit 30. The door operator system 100 is mounted to a wall 7.

The door operator comprises a first and a second activation sensor 6. The first activation sensor 6 monitors an outer activation area A in front of the door leaf 5. The second activation sensor 6 monitor an inner activation area D on the inner side of the door leaf 5. The door operator 1 comprises a first presence sensor 8. The first presence sensor 8 monitor an outer risk area B in front of the door leaf 5 and an inner risk area C on the inner side of the door leaf 5.

The first and second activation sensors 6 and first presence sensors 8 monitor the activation and presence areas A, B, C, D of the door operator system 100. When a sensor 6, 8 detects a person or an object in the area A, B, C, D which it monitors it creates and send activation and presence data to the control unit 3 and the supervise unit 4.

Figure 9:
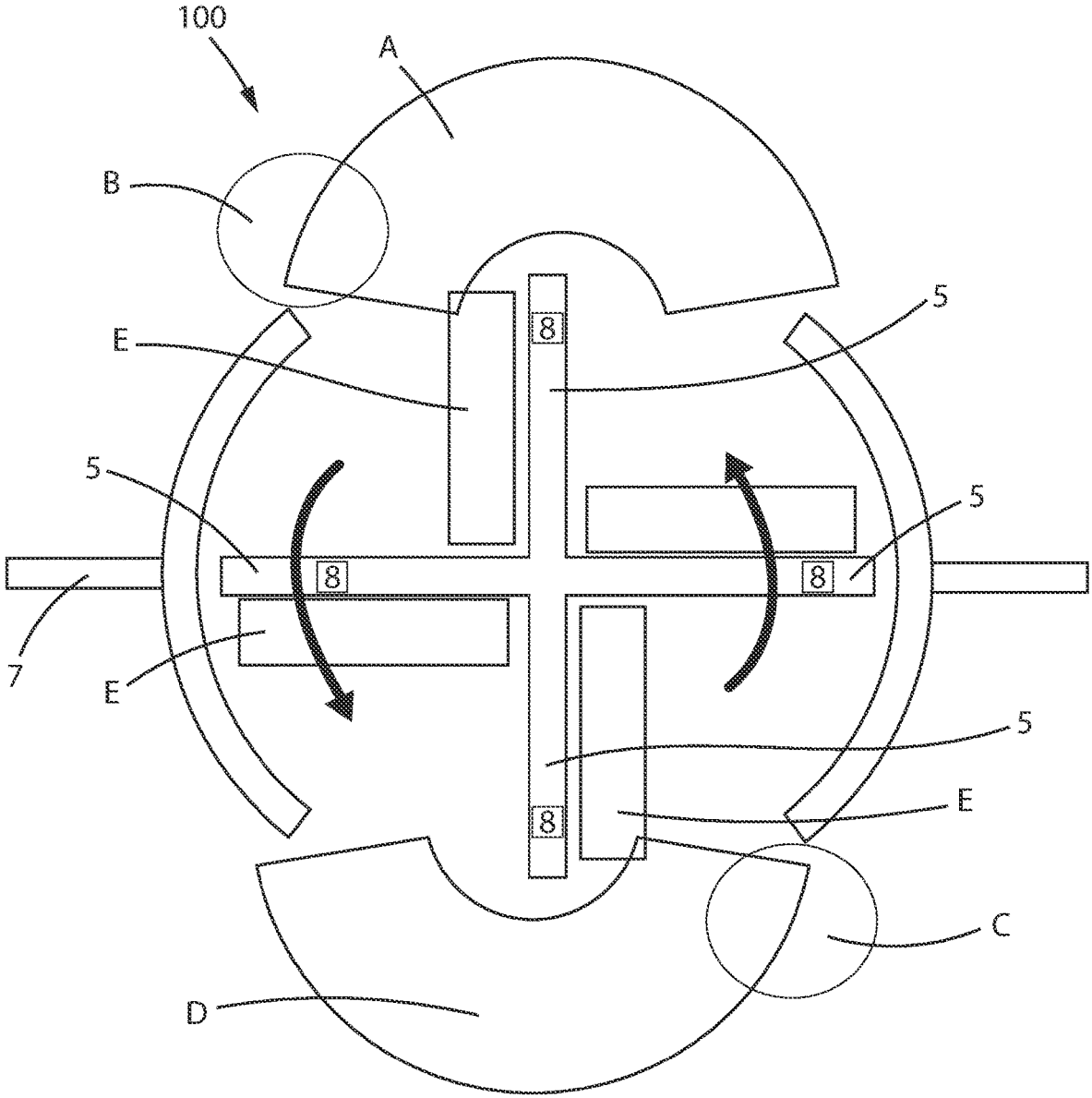
FIG. 9 shows a cross sectional view of a revolving door and a door operator system in accordance with an aspect of the invention.

The door operator system 100 disclosed in FIG. 9 is a revolving door operator 1 connected to a four door leafs 5 accordance with the above. The door operator 1 could be connected to the remote entity 50 and the user interface 20 via the radio communication unit 30. The door operator system 100 is mounted to a wall 7.

The door operator comprises a first and a second activation sensor 6. The first activation sensor 6 monitors an outer activation area A in front of the door leaf 5. The second activation sensor 6 monitor an inner activation area D on the inner side of the door leaf 5. The door operator 1 comprises a first and a second presence sensor 8. The first presence sensor 8 monitor an outer risk area B between the door leaf 5 and the wall 7 on the outer side of the door. and an inner risk area C on the inner side of the door leaf 5. The second presence sensor 8 monitor an inner risk area C between the door leaf 5 and the wall 7 on the inner side of the door. The door operator further comprises third, fourth, fifth and sixth presence sensor 8 that is each is connected to a door leaf 5. The third, fourth, fifth and sixth presence sensor 8 monitors a risk area E in front of the door leaf 5.

According to an aspect a conflicting data and/or uncommon sequence of activation and presence data is that any of the presence sensors 8 detects a person or an object in the risk area B, C, E in front of a door leaf when the door is closed, and at the same time inner or outer activation sensors is not detecting anything in the activation areas A, D. If this conflicting data and/or uncommon sequence of activation and presence data occurs frequently (1 out of 10 openings) this is an indication of a potential malfunction.

According to an aspect the potential problem could be that the inner activation sensors 6 is broken or need adjustment, if it is the inner presence sensor 8 that is detecting a person or object.

According to an aspect the potential problem could be that the outer activation sensors 6 is broken or need adjustment, if it is the outer presence sensor 8 that is detecting a person or object.

According to an aspect a conflicting data and/or uncommon sequence of activation and presence data is that any of the presence sensors 8 frequently (more that 1 out of 10) detects a person or an object in the risk area B, C, E in the same position when the door leafs 5 are rotating.

According to an aspect the potential problem could be that the first or second presence sensor 8 is detecting a door leaf 5 when it is passing.

According to an aspect the potential problem could be that the third, fourth, fifth or sixth presence sensor 8 is detecting the wall 7 when it is passing.

According to an aspect the potential problem could be that the third, fourth, fifth or sixth presence sensor 8 is detecting the wall 7 when it is passing.

According to an aspect a conflicting data and/or uncommon sequence of activation and presence data is that the inner or outer activation sensor 6 detects a person or an object, and at the same time the presence sensors 8 is not detecting anything. If this conflicting data and/or uncommon sequence of activation and presence data occurs frequently (1 out of 10 openings) this is an indication of a potential malfunction.

According to an aspect the potential problem could be that the first or second activation sensor 6 that is detecting an object needs to be adjusted or replaced.

According to an aspect the potential problem could be that the first or second activation sensor 6 that is detecting an object needs to be replaced with another type of activation sensor that ignores cross traffic at the door leaf 5 since the sequence is indicating that the door is rotating without people.

According to an aspect the potential problem could be that the presence sensor 8 that is not detecting an object needs to be adjusted or replaced.

According to an aspect a conflicting data and/or uncommon sequence of activation and presence data is that the first or second activation sensors 6 is frequently detecting a person or an object in the same position. According to an aspect the potential problem could be that the activation sensor 6 needs to be adjusted as it might see a reflection from the door leafs or other moving parts of the door operator system 11.

According to some aspects, the determined conflicting data and/or uncommon sequence of activation and presence data is an indication of that something is wrong in the door operator 1 and/or the door leaf 5. Put in another way, by identifying and determining conflicting data and/or uncommon sequence of activation and presence data in the sensor data the status of the door operator system 100 could be determined. According to some aspects, if no conflicting data and/or uncommon sequence of activation and presence data is detected this is an indication of that all is OK in the door operator system 100.

According to an aspect, the determined conflicting data and/or uncommon sequence of activation and presence data could be sent directly to the service provider via the radio communication interface 30.

By identifying and detecting that there is conflicting data and/or uncommon sequence of activation and presence data this could reduce the downtime of a door operator system 100 since it reduces the time for identifying a fault and which part that is causing it. Further, it also can reduce the cost of service since the service provider knows which parts that needs service before he arrives at the door operator 1 and can plan the service better and have the correct components with him.

According to an aspect, the supervise unit 4 is arranged to receive feedback information after a service of the door operator 1 comprising information of if the determined status pattern was correct or not.

A damaged activation or presence sensor 6, 8 can generate data based on a "ghost" impulse, i.e. generate activation or presence data without any person present in the observation area A, B, C, D, E.

Figure 10:
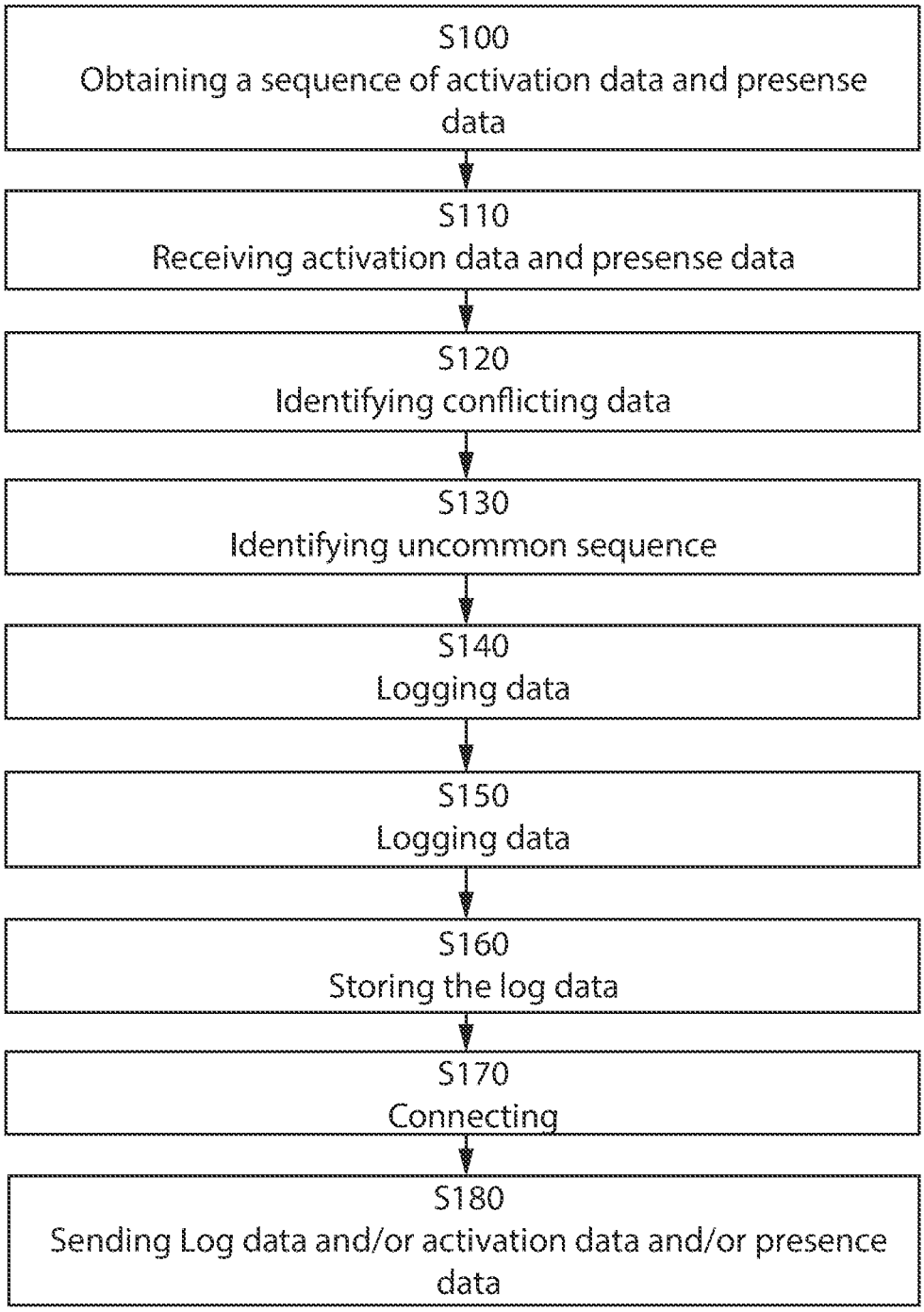
FIG. 10 shows a method performed in a door operator system in accordance with an aspect of the invention.

The method performed in the door operator system 100 is disclosed in FIG. 10 and hereafter, the method of how the door operator system 100 in FIG. 1-9. In accordance to aspects of the invention will be described with reference to FIG. 10.

The method comprises:

obtaining S100, in the door operator, a sequence of activation data and presence data from at least a first and a second activation sensor 6 and at least a first presence sensor 8;

receiving S110, in the supervise unit 4, activation data from the at least first and second activation sensors 6 and presence data from the at least first presence sensor 8, and identifying S120 a conflicting data in a sequence of the (received) activation data and presence data.

According to an aspect the method further comprise the step of identifying S130 an uncommon sequence of (received) activation data and presence data.

According to an aspect the method further comprise the step of logging data S140 associated with of from which activation and/or presence sensor 6, 8 the conflicting data is received.

According to an aspect the method further comprise the step of logging data S150 associated with the identified uncommon sequence of (received) activation data and presence data.

According to an aspect the method further comprise the step of storing S160, in a data storage unit 10, the log data and/or the activation data and/or the presence data.

According to an aspect the method further comprise the step of connecting S170 the supervise unit 4 to at least one remote entity 50 and to sending S180 log data and/or activation data and/or the presence data to the at least one remote entity 50.

According to an aspect the step of connecting S170 comprise connecting the supervise unit 4 to the at least one remote entity 50 via the radio communication interface 30.

According to an aspect the step of receiving S110 comprise receiving activation data and presence data associated with at least a cycle of moving the door leaf 5 from a closed position to an open position and/or from an open position to a closed position.

The step of obtaining S100 further comprises obtaining object property data from at least the first and second activation sensor 6, the first presence sensor 8 or an auxiliary sensor. Said object property data is associated with the properties of one or more objects detected by at least said first and second activation sensor 6, the first presence sensor 8 or the auxiliary sensor. The step of receiving S110 further comprises receiving object property data at least from the first and second activation sensors 6, the at least first presence sensor 8 or the auxiliary sensor. The step of identifying S120 further comprises identifying a conflicting data in a sequence of the received activation data, presence data and object property data.

According to an aspect, the object property data at least comprises data indicative of the velocity of an object detected by at least the first and second activation sensor 6, the first presence sensor 8 or the auxiliary sensor, the direction of movement of an object detected by at least the first and second activation sensor 6, the first presence sensor 8 or the auxiliary sensor or the number of present objects detected by at least the first and second activation sensor 6, the first presence sensor 8 or the auxiliary sensor.

According to another aspect of the invention a method for moving at least one door leaf 5 between a closed and an open position so as to achieve a plurality of operational states of said door leaf 5. The operational states include a closed state corresponding to the closed position of the at least one door leaf 5, an opened state corresponding to the open position of the at least one door leaf 5, an opening state defined by the at least one door leaf 5 moving from the open towards the closed position and a closing state defined by the at least one door leaf 5 moving from the closed towards the open position. The door operator system 100 further comprises a door operator 1 and a supervise unit 4.

The method comprising:

obtaining S100, in the door operator, a sequence of operational state data associated with the operational state of the door leaf 5 from the drive unit 2 and presence data from from at least a first presence sensor 8;

receiving S110, in the supervise unit 4, operational state data from the drive unit 2 and presence data from the at least first presence sensor 8, and identifying S120 a conflicting data in a sequence of at least the received operational state data and presence data.

According to an aspect, the method further comprises the step of identifying S130 an uncommon sequence of at least operational state data and presence data.

According to an aspect, the method further comprises the step of logging data S140 associated with of from which presence sensor 8 the conflicting data is received.

According to an aspect, the method further comprises comprising the step of logging data S150 associated with the identified uncommon sequence of at least received operational state data and presence data.

According to an aspect, the step of obtaining S100 further comprises, in the door operator 1, obtaining positional data associated with a door leaf position of the at least one door leaf 5 from the drive unit 2, the step of receiving S110 further comprises, in the supervise unit 4, receiving positional data associated with the door leaf position from the drive unit 2 and the step of identifying S120 further comprises identifying a conflicting data in a sequence of at least the received operational state data, presence data and positional data.

According to an aspect, the step of identifying S130 further comprises identifying an uncommon sequence of at least operational state data, presence data and positional data.

According to an aspect, the step of obtaining S100 further comprises, in the door operator 1, obtaining activation data from at least a first and a second activation sensor 6, the step of receiving S110 further comprises, in the supervise unit 4, receiving activation data from the at least first and second activation sensors 6 and the step of identifying S120 further comprises identifying a conflicting data in a sequence of at least the received operational state data, presence data and activation data.

According to an aspect, the step of identifying S130 further comprises identifying an uncommon sequence of at least operational state data, presence data and activation data.

According to an aspect, the method further comprises the step of storing S160, in a data storage unit 10, the log data and/or the operational state data and/or the presence data and/or the positional data and/or the activation data.

According to an aspect, the method further comprises the step of connecting S170 the supervise unit 4 to at least one remote entity 50 and to send S180 log data and/or operational state data and/or the presence data and/or the positional data and/or the activation data to the at least one remote entity 50.

According to an aspect, the step of connecting S170 comprises connecting the supervise unit 4 to the at least one remote entity 50 via a radio communication interface 30.

According to an aspect the door operator 1 is a revolving door operator, a swing door operator, a hinged door operator, an up and over door operator, a roll door operator, a garage door operator, an industrial door operator, a high speed door operator, a sectional door operator, a gate operator, a barrier operator, an or any device having the same function as a door operator.

The person skilled in the art realizes that the present invention by no means is limited to the preferred embodiments described above. On the contrary, many modifications and variations are possible within the scope of the appended claims. For example, a sliding door set may comprise of more than two sliding door leafs, arranged in the same way as discussed above.

The description of the aspects of the disclosure provided herein has been presented for purposes of illustration. The description is not intended to be exhaustive or to limit aspects of the disclosure to the precise form disclosed, and modifications and variations are possible in light of the above teachings or may be acquired from practice of various alternatives to the provided aspects of the disclosure. The examples discussed herein were chosen and described in order to explain the principles and the nature of various aspects of the disclosure and its practical application to enable one skilled in the art to utilize the aspects of the disclosure in various manners and with various modifications as are suited to the particular use contemplated. The features of the aspects of the disclosure described herein may be combined in all possible combinations of methods, apparatus, modules, systems, and computer program products. It should be appreciated that the aspects of the disclosure presented herein may be practiced in any combination with each other.

It should be noted that the word "comprising" does not necessarily exclude the presence of other elements or steps than those listed. It should further be noted that any reference signs do not limit the scope of the claims.

The invention claimed is:

1. A door operator system for moving at least one door leaf between a closed and an open position, the system comprising:

a door operator and a supervise unit, wherein the door operator comprises a drive unit, the drive unit is adapted to be connected to and move the at least one door leaf between the open and closed position achieve a plurality of operational states of the at least one door leaf, the plurality of operational states including:

a closed state corresponding to the closed position of the at least one door leaf;

an opened state corresponding to the open position of the at least one door leaf;

an opening state defined by the at least one door leaf moving from the closed position towards the open position; and a closing state defined by the at least one door leaf moving from the open position towards the closed position;

at least one presence sensor connected to a control unit and configured to monitor at least one risk area immediately adjacent to or surrounding the at least one door leaf, and send presence data associated with an object detected in the at least one in risk area to the control unit;

at least a first and a second activation sensor connected to the control unit;

wherein the first activation sensor is configured to monitor at least a first activation area located at an outer side of the at least one door leaf, and outside of the at least one risk area;

wherein the second activation sensor is configured to monitor at least a second activation area located at an inner side of the at least one door leaf, and outside of the at least one risk area;

wherein the first and second activation sensors are arranged to send activation data associated with the object or another object detected in the first or second activation area to the control unit, wherein the control unit is connected to the drive unit and arranged to control a movement of the drive unit at least based on the activation data and presence data;

wherein the drive unit is arranged to send operational state data associated with at least one of the plurality of operational states of the at least one door leaf to the control unit, and wherein the supervise unit is adapted to receive the operational state data from the drive unit and the presence data from the at least one presence sensor, and configured to identify a conflicting data in a sequence of at least the operational state data and the presence data.

2. The door operator system according to claim 1, wherein the supervise unit is configured to identify an uncommon sequence of at least the operational state data and the presence data.

3. The door operator system according to claim 2, wherein the supervise unit is configured to log data associated with the identified uncommon sequence of at least the operational state data and the presence data.

4. The door operator system according to claim 3, wherein the logged data comprise one or more numbers of uncommon sequence, type of uncommon sequence, time, which activation or the at least one presence sensor the conflicting data is received from, a number of contradictory data received from each activation sensor or the at least one presence sensor, local temperature and local humidity.

5. The door operator system according to claim 3, wherein the supervise unit is connected to and adapted to receive the activation data from the first and second activation sensors and configured to identify a conflicting data in a sequence of at least the operational state data, the presence data, and the activation data.

6. The door operator system according to claim 5, wherein the supervise unit is configured to identify an uncommon sequence of at least the operational state data, the presence data, and the activation data.

7. The door operator system according to claim 5, wherein the supervise unit comprises a data storage unit configured to store the log data, the operational state data, the presence data, the positional data, or the activation data.

8. The door operator system according to claim 1, wherein the supervise unit is configured to log data associated with which of the at least one presence sensor the conflicting data is received from.

9. The door operator system according to claim 1, wherein the drive unit is arranged to send positional data associated with a door leaf position of the at least one door leaf to the control unit, and wherein the supervise unit is adapted to receive the positional data from the drive unit and configured to identify a conflicting data in a sequence of at least the operational state data, the presence data and the positional data.

10. The door operator system according to claim 9, wherein the supervise unit is configured to identify an uncommon sequence of at least the operational state data, the presence data, and the positional data.

11. The door operator system according to claim 1, wherein the supervise unit is configured to be connected to at least one remote entity and to send log data, the operational state data, the presence data, positional data, or the activation data to the at least one remote entity.

12. The door operator system according to claim 1, further comprising a radio communication interface connected to the supervise unit and configured to communicate with at least one remote entity.

13. The door operator system according to claim 12, wherein the supervise unit is configured to transmit log data, the operational state data, the presence data, positional data, or the activation data to the at least one remote entity via the radio communication interface.

14. A method in a door operator system for moving at least one door leaf between a closed and an open position to achieve a plurality of operational states of the at least one door leaf, the plurality of operational states the states including (a) a closed state corresponding to the closed position of the at least one door leaf, (b) an opened state corresponding to the open position of the at least one door leaf, (c) an opening state defined by the at least one door leaf moving from the open towards the closed position, and (d) a closing state defined by the at least one door leaf moving from the closed towards the open position, the door operator system comprising a door operator and a supervise unit, the method comprising:

obtaining by the door operator a sequence of operational state data associated with at least one of the plurality of operational states of the at least one door leaf from a drive unit, and presence data from at least one presence sensor;

receiving by the supervise unit the operational state data from the drive unit and presence data from the at least one presence sensor; and identifying a conflicting data in a sequence of at least the received operational state data and presence data.

15. The method in a door operator system according to claim 14 further comprising the step of identifying an uncommon sequence of at least the operational state data and the presence data.

16. The method in a door operator system according to claim 15 further comprising the step of logging data associated with the identified uncommon sequence of at least the operational state data and the presence data.

17. The method in a door operator system according to claim 15, wherein the step of identifying the uncommon sequence comprises identifying an uncommon sequence of at least operational state data, presence data and positional data.

18. The method in a door operator system according to claim 17, wherein the step of identifying the uncommon sequence comprises identifying an uncommon sequence of at least operational state data, presence data and activation data.

19. The method in a door operator system according to claim 14 further comprising the step of logging data associated with which of the at least one presence sensor the conflicting data is received from.

20. The method in a door operator system according to claim 19, wherein the step of obtaining the sequence of operational state data comprises obtaining activation data from at least a first and a second activation sensor, wherein the step of receiving the operational state data comprises receiving the activation data from the at least first and second activation sensors, and wherein the step of identifying the conflicting data comprises identifying a conflicting data in a sequence of at least the received operational state data, presence data and activation data.

21. The method in a door operator system according to claim 20 further comprising the step of storing, in a data storage unit, log data, the operational state data, the presence data, the positional data, and the activation data.

22. The method in a door operator system according to claim 21 further comprising the step of connecting the supervise unit to at least one remote entity and the step of sending the log data, operational state data, presence data, positional data, and activation data to the at least one remote entity.

23. The method in a door operator system according to claim 22, wherein the step of connecting the supervise unit to the at least one remote entity comprises connecting the supervise unit to the at least one remote entity via a radio communication interface.

24. The method in a door operator system according to claim 14, wherein the step of obtaining the sequence of operational state data by the door operator comprises obtaining positional data associated with a door leaf position of the at least one door leaf from the drive unit, wherein the step of receiving by the supervise unit the operational state data comprises receiving the positional data associated with the door leaf position from the drive unit, and wherein the step of identifying the conflicting data comprises identifying the conflicting data in a sequence of at least the received operational state data, presence data and positional data.

25. A door operator system for moving at least one door leaf between a closed and an open position, the system comprising:

a door operator and a supervise unit, wherein the door operator comprises:

a drive unit adapted to be connected to and move the at least one door leaf between the open and closed position;

at least one presence sensor connected to a control unit and configured to monitor at least one risk area immediately adjacent to or surrounding the at least one door leaf, and send presence data associated with an object detected in the at least one risk area to the control unit; and at least a first and a second activation sensor connected to the control unit, wherein the first activation sensor is configured to monitor at least a first activation area located at an outer side of the at least one door leaf and outside of the at least one risk area, wherein the second activation sensor is configured to monitor at least a second activation area located at an inner side of the at least one door leaf and outside of the least one risk area, and wherein the first and second activation sensors are arranged to send activation data associated with an object detected in the first or second activation area to the control unit;

wherein the control unit is connected to the drive unit and arranged to control a movement of the drive unit at least based on the activation data and presence data; and wherein the supervise unit is connected to and adapted to receive the activation data from the at least first and second activation sensors and the presence data from the at least one presence sensor, and configured to identify a conflicting data in a sequence of at least the activation data and the presence data.

26. The door operator system according to claim 25, wherein the supervise unit is configured to identify an uncommon sequence of the activation data and the presence data.

27. The door operator system according to claim 26, wherein the uncommon sequence of the activation data and the presence data is one or more of a predefined sequence of the activation data and the presence data.

28. The door operator system according to claim 25, wherein the supervise unit is configured to log data related to which one of the presence and activation sensors the conflicting data is received from.

29. The door operator system according to claim 26, wherein the supervise unit is configured to log data associated with the identified uncommon sequence of the activation data and the presence data.

30. The door operator system according to claim 29, wherein the logged data comprises one or more numbers of the uncommon sequence, a type of the uncommon sequence, time, from which one of the activation and presence sensors the conflicting data is received from, a number of contradictory data received from each one of the activation and the presence sensors, a local temperature, and a local humidity.

31. The door operator system according to claim 25, wherein the sequence of the activation data and the presence data comprise at least the activation data and the presence data associated with a cycle of moving the at least one door leaf from a closed position to an open position or from an open position to a closed position.

32. The door operator system according to claim 25, wherein the supervise unit is configured to be connected to at least one remote entity and to send log data, the activation data, and the presence data to the at least one remote entity.

33. The door operator system according to claim 25 further comprising a radio communication interface connected to the supervise unit and configured to communicate with at least one remote entity.

34. The door operator system according to claim 33, wherein the supervise unit is configured to transmit log data, the activation data, and the presence data to the at least one remote entity via the radio communication interface.

35. The door operator system according to claim 25, wherein the first and second activation sensors, the at least one presence sensor or at least one auxiliary sensor each connected to the control unit and each configured to monitor respective one of the first activation area, the second activation area, and the at least one risk area are configured to detect properties associated with one or more objects detected in the first or second activation areas or the at least one risk area, and send object property data to the control unit, wherein the supervise unit is connected to and adapted to receive the object property data from at least one of the first and second activation sensors, the at least one presence sensor, and the at least one auxiliary sensor, and wherein the supervise is configured to identify the conflicting data in a sequence of the activation data, the presence data and the object property data.

36. The door operator system according to claim 35, wherein the object property data comprises at least data indicative of a velocity of the one or more objects detected in the first or the second activation areas or the at least one risk area, a direction of movement of the one or more objects detected in the first or the second activation area, or the at least one risk area a number of detected objects present in the first or the second activation areas or the at least one risk area.

37. A method in a door operator system for moving at least one door leaf between a closed and an open position, the door operator system comprising a door operator and a supervise unit, the method comprising:

obtaining by the door operator a sequence of activation data from at least a first activation sensor and a second activation sensor, and a sequence of presence data from at least one presence sensor;

receiving by the supervise unit activation data from the at least first and second activation sensors and presence data from the at least one presence sensor; and identifying a conflicting data in the sequence of activation data and presence data.

38. The method in a door operator system according to claim 37 further comprising the step of identifying an uncommon sequence of activation data and presence data.

39. The method in a door operator system according to claim 38 further comprising the step of logging data associated with the identified uncommon sequence of activation data and presence data.

40. The method in a door operator system according to claim 39 further comprising the step of storing, in a data storage unit, the logged data, the activation data, or the presence data.

41. The method in a door operator system according to claim 40 further comprising the step of connecting the supervise unit to at least one remote entity and sending logged data, the activation data, or the presence data to the at least one remote entity.

42. The method in a door operator system according to claim 41, wherein the step of connecting comprises connecting the supervise unit to the at least one remote entity via a radio communication interface.

43. The method in a door operator system according to claim 37 further comprising the step of logging data related to which one of the activation sensors or the at least one presence sensor the conflicting data is received from.

44. The method in a door operator system according to claim 37, wherein the step of receiving by the supervise unit the activation and presence data comprises receiving the activation and presence data associated with at least a cycle of moving the at least one door leaf from a closed position to an open position or from an open position to a closed position.

45. The method in a door operator system according to claim 37, wherein the step of obtaining by the door operator a sequence of activation and presence data comprises obtaining object property data from at least the first and second activation sensor, the at least one presence sensor or an auxiliary sensor, the object property data being associated with properties of one or more objects detected by at least the first and second activation sensor, the at least one presence sensor or the auxiliary sensor, wherein the step of receiving by the supervise unit the activation and presence data comprises receiving the object property data at least from the first and second activation sensors, the at least one presence sensor or the auxiliary sensor, and wherein the step of identifying the conflicting data comprises identifying a conflicting data in a sequence of the activation data, presence data and object property data.

46. The method in a door operator system according to claim 45, wherein the object property data comprises at least data indicative of a velocity of the object detected by at least the first and second activation sensors, the at least one presence sensor or the auxiliary sensor, a direction of movement of the object detected by at least the first and second activation sensors, the at least one the presence sensor or the auxiliary sensor, or a number of present objects detected by at least the first and second activation sensor, the at least one presence sensor or the auxiliary sensor.

* * * * *